US007385880B2

(12) United States Patent
Akao

(10) Patent No.: US 7,385,880 B2
(45) Date of Patent: Jun. 10, 2008

(54) GREASE COMPOSITION FOR PRECISION EQUIPMENT AND TIMEPIECE CONTAINING THE SAME

(75) Inventor: Yuji Akao, Tokyo (JP)

(73) Assignee: Citizen Holdings Co., Ltd., Tokyo (JP)

( * ) Notice: Subject to any disclaimer, the term of this patent is extended or adjusted under 35 U.S.C. 154(b) by 498 days.

(21) Appl. No.: 10/493,170

(22) PCT Filed: Aug. 19, 2003

(86) PCT No.: PCT/JP03/10447

§ 371 (c)(1),
(2), (4) Date: Apr. 20, 2004

(87) PCT Pub. No.: WO2004/018594

PCT Pub. Date: Mar. 4, 2004

(65) Prior Publication Data

US 2005/0014658 A1 Jan. 20, 2005

(51) Int. Cl.

| | |
|---|---|
| ***G04B 1/10*** | (2006.01) |
| ***G04B 31/08*** | (2006.01) |
| ***C10M 169/04*** | (2006.01) |
| ***C10M 137/04*** | (2006.01) |

(52) U.S. Cl. ..... 368/62; 508/280; 508/441; 508/429

(58) Field of Classification Search ..... 508/280, 508/441, 429; 368/62
See application file for complete search history.

(56) References Cited

U.S. PATENT DOCUMENTS

| | | | | |
|---|---|---|---|---|
| 5,156,756 | A * | 10/1992 | Kojima et al. | 508/178 |
| 6,010,985 | A * | 1/2000 | Heimann et al. | 508/136 |
| 6,271,182 | B1 | 8/2001 | Akiyama | |
| 6,339,049 | B1 | 1/2002 | Funahashi et al. | |
| 6,858,567 | B2 | 2/2005 | Akao | |

FOREIGN PATENT DOCUMENTS

| | | | |
|---|---|---|---|
| EP | 1 201 734 | A1 | 5/2002 |
| JP | 53-031706 | A | 3/1978 |
| JP | 4-353599 | A | 12/1992 |
| JP | 11-035963 | A | 2/1999 |
| JP | 11-336760 | A | 12/1999 |
| JP | 11-336761 | A | 12/1999 |
| JP | 2001-172656 | A | 6/2001 |
| JP | 2002-308125 | A | 10/2002 |
| WO | WO 01/59043 | A1 | 8/2001 |
| WO | WO 0159043 | A1 * | 8/2001 |

OTHER PUBLICATIONS

Pirro, D.M. and Wessol, A.A., Lubrication Fundamentals, Second Edition, 2001, Marcel Dekker, Section 4(1).*
Dickey, J.R., Lubrication and Lubricants, in Kirk-Othmer Encyclopedia of Chemical Technology, 2005, John Wiley & Sons, p. 31. Retrieved from the internet at <http://www.mrw.interscience.wiley.com/emrw/9780471238966/kirk/article/lubrboos.a01/current/pdf>.*

* cited by examiner

*Primary Examiner*—Glenn Caldarola
*Assistant Examiner*—Jim Goloboy
(74) *Attorney, Agent, or Firm*—The Webb Law Firm, P.C.

(57) ABSTRACT

A grease composition for a precision instrument comprising a lithium soap grease or a urea grease, and an anti-wear agent, wherein the lithium soap grease and the urea grease are each a grease having no hydroxyl group in a molecule, and the anti-wear agent is contained in an amount of 0.1 to 20% by weight based on the total amount of the grease composition. By the use of the grease composition for a sliding mechanism of a precision instrument such as a watch, an appropriate slip torque can be obtained, and the precision instrument such as a watch can operate stably.

18 Claims, No Drawings

GREASE COMPOSITION FOR PRECISION EQUIPMENT AND TIMEPIECE CONTAINING THE SAME

FIELD OF THE INVENTION

The present invention relates to a grease composition for a precision instrument and a watch using the same. More particularly, the invention relates to a grease composition used for a slide portion of a precision instrument such as a watch, e.g., a sliding mechanism of a second wheel and pinion of a watch part, and a watch in which the grease composition is used.

BACKGROUND OF THE INVENTION

As watches, there are two types of mechanical watches which operate by the use of power of a mainspring and electronic watches which operate by electric power of battery loaded therein. Each of the electronic watches and the mechanical watches has a train wheel portion to move hour hand, minute hand and second hand, such as wheels and bridges, and a slide portion such as levers. For the train wheel portion and the slide portion, parts made of metals or plastics are used taking processability and strength into account.

For the operation of the hands of watches, a magnetized rotor rotates 180° for one second and this rotation is transmitted in the following manner. That is to say, the rotation of the rotor is transmitted to a fifth wheel and pinion, a fourth wheel and pinion, a third wheel and pinion, a second wheel and pinion, a minute wheel, and an hour wheel in this order, and the fourth wheel and pinion moves the second hand, the second wheel and pinion moves the minute hand, and the hour wheel moves the hour hand, whereby each hand is operated.

Watches usually have a time-adjusting function. When a crown is pulled in order to adjust time, a clutch wheel is geared into the minute wheel. When the crown is revolved in this state, the clutch wheel is rotated to thereby rotate the minute wheel. By the rotation of the minute wheel, the hour wheel is rotated, whereby the hour hand can be moved. By the rotation of the minute wheel, the second wheel and pinion is also rotated, whereby the minute hand can be moved.

The minute wheel, however, is interlocked with the rotor through the second wheel and pinion, the third wheel and pinion, the fourth wheel and pinion, and the fifth wheel and pinion, so that if the crown is revolved, even the rotor is rotated. Then, in order to prevent rotation of the rotor caused by adjusting time, watches are equipped with a braking mechanism and a sliding mechanism to rotate only wheels necessary to adjust time. The sliding mechanism is usually set on the second wheel and pinion.

The sliding mechanism has an appropriate torque (referred to as "slip torque"), and when a force higher than a certain torque is applied, the sliding mechanism is activated, and thereby, rotation is not transmitted between the second wheel and pinion, and the third wheel and pinion. More specifically, in the usual motion of hands, the rotation is transmitted from the third wheel and pinion to the second wheel and pinion, but when the crown is revolved, a force of a certain torque is applied to actuate the sliding mechanism, whereby rotation is not transmitted from the second wheel and pinion to the third wheel and pinion.

However, if the time-adjusting operation is repeatedly carried out, the sliding mechanism suffers frictional wear and is deteriorated to thereby lower the slip torque. Consequently, it becomes difficult to stop the hand at the desired position in the time-adjusting operation, or also in the usual motion, the sliding mechanism sometimes is activated to thereby stop the motion of the minute hand.

Therefore, a lithium soap grease containing as a base oil an ester type synthetic oil or a mineral oil is conventionally poured into the sliding mechanism to prevent deterioration of the sliding mechanism caused by frictional wear and thereby inhibit lowering of torque. However, if a synthetic oil having a large total acid number and exhibiting metal corrosiveness (e.g., Mabis 9415) is used for a metal part of a precision instrument such as a watch, the metal part is occasionally tarnished or dissolved. Further, if a grease (e.g., CH-1 available from Citizen Watch Co., Ltd.) having poorer storage stability than a high-purity synthetic base oil (e.g., International Publication No. WO01/59043) is used, there is brought about a problem that the sliding mechanism is immediately deteriorated. On this account, development of grease having a small total acid number and exhibiting excellent storage stability has been desired.

Furthermore, grease having been poured into the sliding mechanism sometimes mingles with a lubricating oil that has been applied in order to slide the second wheel and pinion. As a result, deterioration of the slide portion or change of properties of the lubricating oil sometimes occurs. For example, if the aforesaid Mabis 9415 is mixed with the lubricating oil, metal corrosiveness of the lubricating oil is increased to sometimes deteriorate the slide portion. If the CH-1 available from Citizen Watch Co., Ltd. is mixed with the lubricating oil, change of properties of the lubricating oil takes place and the properties inherent in the lubricating oil cannot be obtained in some cases.

Then, as a sliding mechanism having an appropriate torque, a second wheel and pinion manufactured in combination with a resin has been proposed (Japanese Patent Publication No. 16705/1996, Japanese Patent Laid-Open Publication No. 123783/1994, Japanese Patent Laid-Open Publication No. 196747/1993). This second wheel and pinion is employable without oil-feeding and is prevented from mixing of a lubricating oil, but it is difficult to easily manufacture the second wheel and pinion because of its complicated structure. Moreover, there is another problem that the sliding mechanism has poor wear resistance because it is made of a resin.

Other various grease compositions have been heretofore proposed (e.g., Japanese Patent Laid-Open Publication No. 31706/1978, Japanese Patent Laid-Open Publication No. 35963/1999, Japanese Patent Laid-Open Publication No. 336760/1999, Japanese Patent Laid-Open Publication No. 336761/1999, Japanese Patent Laid-Open Publication No. 172656/2001, Japanese Patent Laid-open Publication No. 308125/2002), but these grease compositions are intended for large-sized machines, and their consistency is large. Therefore, even if these grease compositions are used for sliding mechanism of watches, it is difficult that the sliding mechanism has a suitable torque.

It is an object of the present invention to provide a grease composition for a precision instrument which has no metal corrosiveness, hardly suffers change of properties and can maintain an appropriate slip torque in a precision instrument such as a watch. It is another object of the invention to provide a watch which exhibits stable operating performance by the use of the grease composition for its sliding mechanism.

SUMMARY OF THE INVENTION

The present inventor has earnestly studied to solve the above problems, and as a result, he has found that a grease composition for a precision instrument containing grease having no hydroxyl group in a molecule does not have metal corrosiveness and hardly suffers change of properties. Based on the finding, the present invention has been accomplished.

That is to say, a grease composition for a precision instrument according to the invention is a grease composition for a precision instrument comprising a lithium soap grease or a urea grease, and an anti-wear agent, wherein the lithium soap grease and the urea grease are each grease having no hydroxyl group in a molecule, and the anti-wear agent is contained in an amount of 0.1 to 20% by weight based on the total amount of the grease composition.

The lithium soap grease or the urea grease is preferably obtained from a polyol ester oil having no hydroxyl group in a molecule, a paraffinic hydrocarbon oil comprising an α-olefin polymer of 30 or more carbon atoms, or an ether oil having no hydroxyl group in a molecule.

The ether oil is preferably an ether oil represented by the following formula (1):

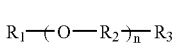

$$R_1-(O-R_2)_n-R_3 \quad (1)$$

wherein $R_1$ and $R_3$ are each independently an alkyl group of 1 to 18 carbon atoms or a monovalent aromatic hydrocarbon group of 6 to 18 carbon atoms, $R_2$ is an alkylene group of 1 to 18 carbon atoms or a divalent aromatic hydrocarbon group of 6 to 18 carbon atoms, and n is an integer of 1 to 5.

The anti-wear agent is preferably at least one compound selected from a neutral phosphate, a neutral phosphite and calcium borate.

The grease composition for a precision instrument of the invention preferably further comprises a solid lubricant in an amount of 0.01 to 5% by weight based on the total amount of the grease composition, and the solid lubricant preferably comprises molybdenum disulfide and/or PTFE particles.

The grease composition for a precision instrument of the invention preferably further comprises a metal deactivator, and the metal deactivator is preferably benzotriazole and/or a derivative thereof.

The grease composition for a precision instrument of the invention preferably further comprises an antioxidant, and the antioxidant is preferably a phenol type antioxidant and/or an amine type antioxidant. The phenol type antioxidant is preferably 2,6-di-tributyl-p-cresol, 2,4,6-tri-t-butylphenol or 4,4'-methylenebis(2,6-di-tributylphenol), and the amine type antioxidant is preferably a diphenylamine derivative.

The lithium soap grease or urea grease, which is contained in the grease composition for a precision instrument of the invention, preferably has a change in weight of not more than 10% by weight after the grease is held at 90° C. for 1000 hours. The grease composition for a precision instrument preferably has a total acid number of not more than 0.2 mgKOH/g.

A watch according to the invention is a watch in which the above-mentioned grease composition for a precision instrument is used for a sliding mechanism of its slide portion.

When the watch of the invention is a watch wherein a grease composition for a precision instrument is used for a sliding mechanism of a slide portion and a lubricating oil composition is used for portions other than the sliding mechanism of the slide portion, a combination of the grease composition for a precision instrument and the lubricating oil is preferably any one of the following combinations:

(1) the grease composition for a precision instrument is a grease composition obtained from a polyol ester oil having no hydroxyl group in a molecule, and the lubricating oil composition is a lubricating oil composition obtained from the polyol ester oil having no hydroxyl group in a molecule;

(2) the grease composition for a precision instrument is a grease composition obtained from a paraffinic hydrocarbon oil comprising an α-olefin polymer of 30 or more carbon atoms, and the lubricating oil composition is a lubricating oil composition obtained from the paraffinic hydrocarbon oil comprising an α-olefin polymer of 30 or more carbon atoms; and (3) the grease composition for a precision instrument is a grease composition obtained from an ether oil having no hydroxyl group in a molecule, and the lubricating oil composition is a lubricating oil composition obtained from the ether oil having no hydroxyl group in a molecule.

A maintenance method of a watch according to the invention is a maintenance method of a watch in which a grease composition for a precision instrument containing a solid lubricant is used for a sliding mechanism of a slide portion, comprising:

after disassembly and washing of the watch, re-assembling the watch using a grease composition for a precision instrument containing no solid lubricant in a sliding mechanism of a slide portion.

DETAILED DESCRIPTION OF THE INVENTION

<Grease Composition for Precision Instrument>

A grease composition for a precision instrument according to the invention contains (A) a lithium soap grease or a urea grease, (B) an anti-wear agent, and if necessary, (C) a solid lubricant, (D) a metal deactivator and (E) an antioxidant. (A) Grease The grease for use in the invention is a lithium soap grease or a urea grease having no hydroxyl group in a molecule. Such grease can be prepared by the use of (a1) a polyol ester oil having no hydroxyl group in a molecule, (a2) a paraffinic hydrocarbon oil, or (a3) an ether oil having no hydroxyl group in a molecule.

(a1) Polyol Ester Oil having No Hydroxyl Group in Molecule

The polyol ester oil having no hydroxyl group in a molecule (referred to as a "polyol ester oil (a1)" simply hereinafter) for use in the invention can be prepared by reacting a polyol having at least two hydroxyl groups in one molecule with a monovalent acid or its salt in a mixing molar ratio ((monovalent acid or its salt)/polyol) of not less than 1. The resulting polyol ester oil (a1) is a complete ester having no hydroxyl group in a molecule.

Examples of polyols having at least two hydroxyl groups in one molecule for use in the invention include neopentyl glycol, trimethylolpropane, pentaerythritol and dipentaerythritol.

Examples of the monovalent acids include:

saturated aliphatic monocarboxylic acids, such as acetic acid, propionic acid, butyric acid, isobutyric acid, valeric acid, pivalic acid, heptanoic acid, octanoic acid, nonanoic acid, decanoic acid, lauric acid, myristic acid and palmitic acid;

unsaturated aliphatic monocarboxylic acids, such as stearic acid, acrylic acid, crotonic acid and oleic acid; and cyclic carboxylic acids, such as benzoic acid, toluic acid, naphthoic acid, cinnamic acid, cyclohexanecarboxylic acid, nicotinic acid, isonicotinic acid, 2-furancarboxylic acid, pyrrol-N-carboxylic acid, monoethyl malonate and ethyl hydrogenphthalate.

Examples of the salts of monovalent acids include chlorides of the above-mentioned monovalent acids.

Examples of the polyol ester oils (a1) include neopentyl glycol-decanoic acid/octanoic acid mixed ester, trimethylolpropane-valeric acid/heptanoic acid mixed ester, trimethyloipropane-decanoic acid/octanoic acid mixed ester, trimethylolpropane nonanoate, and pentaerythritol-heptanoic acid/decanoic acid mixed ester.

(a2) Paraffinic Hydrocarbon Oil

The paraffinic hydrocarbon oil (a2) for use in the invention is desirably an α-olefin polymer of 30 or more carbon atoms, preferably 30 to 50 carbon atoms. The α-olefin polymer is preferably a homopolymer of one monomer selected from ethylene and an α-olefin of 3 to 18 carbon atoms, preferably an α-olefin of 10 to 18 carbon atoms, or a copolymer of at least two monomers selected from ethylene and α-olefins of 3 to 18 carbon atoms, preferably an α-olefin of 10 to 18 carbon atoms. Examples of such polymers include a trimer of 1-decene, a trimer of 1-undecene, a trimer of 1-dodecene, a trimer of 1-tridecene, a trimer of 1-tetradecene, and a copolymer of 1-hexene and 1-pentene.

(a3) Ether Oil having No Hydroxyl Group in Molecule

The ether oil having no hydroxyl group in a molecule (referred to as an "ether oil (a3)" simply hereinafter) for use in the invention is not specifically restricted provided that the ether oil has no hydroxyl group in its molecule, but preferable is an ether oil represented by the following formula (1):

$$R_1-(O-R_2)_n-R_3 \quad (1)$$

wherein $R_1$ and $R_3$ are each independently an alkyl group of 1 to 18 carbon atoms or a monovalent aromatic hydrocarbon group of 6 to 18 carbon atoms, $R_2$ is an alkylene group of 1 to 18 carbon atoms or a divalent aromatic hydrocarbon group of 6 to 18 carbon atoms, and n is an integer of 1 to 5.

Examples of the alkyl groups of 1 to 18 carbon atoms include methyl, ethyl, propyl, isopropyl, n-butyl, isobutyl, sec-butyl, tert-butyl, n-pentyl, isopentyl, tert-pentyl, neopentyl, hexyl, isohexyl, heptyl, octyl, nonyl, decyl, undecyl, dodecyl, tridecyl, tetradecyl, pentadecyl, hexadecyl, heptadecyl and octadecyl.

Examples of the monovalent aromatic hydrocarbon groups of 6 to 18 carbon atoms include phenyl, tolyl, xylyl, benzyl, phenethyl, 1-phenylethyl and 1-methyl-1-phenylethyl.

Examples of the alkylene. groups of 1 to 18 carbon atoms include methylene, ethylene, propylene and butylene.

Examples of the divalent aromatic hydrocarbon groups of 6 to 18 carbon atoms include phenylene and 1,2-naphthylene.

(Grease (A))

The grease (A) for use in the invention is a lithium soap grease or a urea grease of (a1) the polyol ester oil having no hydroxyl group in a molecule, (a2) the paraffinic hydrocarbon oil or (a3) the ether oil having no hydroxyl group in a molecule.

The lithium soap grease can be prepared by a publicly known process using the polyol ester oil (a1), the paraffinic hydrocarbon oil (a2) or the ether oil (a3). For example, the lithium soap grease can be prepared by adding lithium stearate to the polyol ester oil (a1), the paraffinic hydrocarbon oil (a2) or the ether oil (a3) and heating them at the melting point of lithium stearate or above.

The urea grease can be prepared by a publicly known process using the polyol ester oil (a1), the paraffinic hydrocarbon oil (a2) or the ether oil (a3). For example, the urea grease can be prepared by adding a diurea compound represented by the following formula (2) to the polyol ester oil (a1), the paraffinic hydrocarbon oil (a2) or the ether oil (a3) and heating them at the melting point of the diurea compound or above.

$$R_4-HNCONH-R_5-HNCONH-R_6 \quad (2)$$

wherein $R_4$ and $R_6$ are each independently a hydrocarbon group of 1 to 10 carbon atoms, and $R_5$ is a hydrocarbon group of 6 to 15 carbon atoms.

Examples of the $R_4$ and $R_6$ include alkyl groups of 1 to 10 carbon atoms. Of these, butyl, pentyl, hexyl and heptyl are preferred.

Examples of the $R_5$ include groups represented by the following formula:

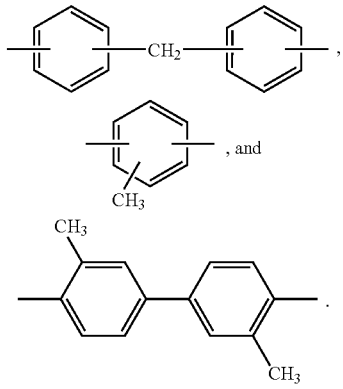

Of these, the groups represented by:

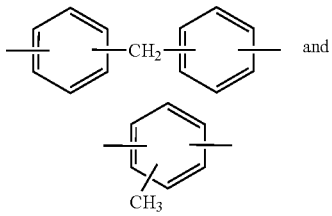

are preferred.

The grease (A) for use in the invention is grease used for a precision instrument such as a watch. The grease (A) has a penetration of ¼-cone (defined by JIS K2220) at 25° C. of a specific range. Herein, the penetration of ¼-cone (JIS K2220) is a depth which ¼-cone (JIS K2220) penetrates into grease at a specified temperature for specified time, as measured by the following manner.

(Measurement Method of Penetration (25° C.) of ¼-cone (JIS K2220))

The penetration (25° C.) of ¼-cone (JIS K2220) is measured by the use of the consistometer and ¼-cone (total amount of a holding bar and the cone: 9.38 g) as described in JIS K2220. A measured sample is prepared in accordance with the method for preparing a sample as described in the ¼-worked penetration measurement method defined.by JIS K2220 in order to homogenize grease, and the temperature of the sample is kept at 25° C. A pot wherein the sample kept at 25° C. is placed is put on the stage of the consistometer, and then a tip of the ¼-cone is brought in contact with the center of a sample surface. Thereafter, the ¼-cone is allowed to penetrate into the sample for specified time (0.1 seconds or 1 second). A reading of indicating gauge at the time is read, and is regarded as a penetration (25° C., unit: mm) of ¼-cone (JIS K2220) for specified time (0.1 seconds or 1 second).

The ¼-cone penetration of the grease (A) can be controlled by mixing, at an appropriate ratio, the polyol ester oil (a1) having no hydroxyl group in a molecule, the paraffinic hydrocarbon oil (a2) or the ether oil (a3) having no hydroxyl group in a molecule with the lithium soap grease or urea grease prepared by the method described above.

The grease (A) for use in the invention has a penetration (25° C.) of ¼-cone (JIS K2220) for 1 second of not less than 5.0 mm, preferably not less than 5.5 mm. Particularly, when the grease composition for a precision instrument of the invention is used for a sliding mechanism, the grease (A) has desirably a penetration (25° C.) of ¼-cone (JIS K2220) for 0.1 seconds of 10.0 to 25.0 mm, preferably 12.0 to 22.0 mm, still preferably 13.0 to 18.0 mm. Further, when the grease composition for a precision instrument of the invention is used for an automatic winding mechanism of a mechanical watch, the grease (A) has desirably a penetration (25° C.) of ¼-cone (JIS K2220) for 1 second of 5.0 to 7.0 mm, preferably 5.7 to 6.7 mm.

When the ¼-cone penetration of the grease (A) is in the above range, the sliding mechanism has a suitable torque, and a precision instrument such as a watch can be stably operated.

The grease (A) for use in the invention has no hydroxyl group in a molecule, and does not absorb moisture or very hardly absorbs moisture. Therefore, a grease composition for a precision instrument containing the grease (A) is free from change of properties and does not exhibit metal corrosiveness. Hence, corrosion of a slide portion of a precision instrument such as a watch is not brought about, and the precision instrument such as a watch can be stably operated. The grease composition for a precision instrument of the invention has a percentage of moisture absorption of usually not more than 1.0% by weight, preferably not more than 0.5% by weight.

In the grease composition for a precision instrument of the invention, the grease (A) is contained in an amount of 80 to 99.8% by weight, preferably 90 to 99% by weight, more preferably 93 to 97% by weight, based on the total amount of the grease composition.

(B) Anti-wear Agent

The anti-wear agent (B) for use in the invention is, for example, a metal type anti-wear agent, a sulfide type anti-wear agent, an acid phosphate type anti-wear agent, an acid phosphite type anti-wear agent, an acid phosphoric ester amine salt, a neutral phosphate type anti-wear agent, a neutral phosphite type anti-wear agent or calcium borate.

Examples of the metal type anti-wear agents include alkyldithiophosphoric acid metal salts, such as zinc diethyldithiophosphate (ZnDTP) and molybdenum diethyldithiophosphate (MoDTP).

Examples of the sulfide type anti-wear agents include alkyl sulfides, such as distearyl sulfide.

Examples of the acid phosphate type anti-wear agents include acid phosphates, such as lauryl acid phosphate.

Examples of the acid phosphite type anti-wear agents include acid phosphites, such as dilauryl hydrogenphosphite.

Examples of the acid phosphoric ester amine salts include lauryl acid phosphate diethylamine salt.

Examples of the neutral phosphate type anti-wear agents include neutral phosphates, such as triethyl phosphate, trioctyl phosphate, tris(tridecyl) phosphate, tristearyl phosphate, trimethylolpropane phosphate, triphenyl phosphate, tricresyl phosphate, trixylenyl phosphate, tris(nonylphenyl) phosphate, tris(2,4-di-t-butylphenyl) phosphate, tetraphenyldipropylene glycol diphosphate, tetraphenyltetra(tridecyl) pentaerythritol tetraphosphate, tetra(tridecyl)-4,4'-isopropylidenediphenyl diphosphate, bis(tridecyl) pentaerythritol diphosphate, bis(nonylphenyl) pentaerythritol diphosphate, distearyl pentaerythritol diphosphate and hydrogenated bisphenol A pentaerythritol phosphate polymer.

Examples of the neutral phosphite type anti-wear agents include neutral phosphites, such as triethyl phosphite, trioctyl phosphite, tris(tridecyl) phosphite, trioleyl phosphite, tristearyl phosphite, trimethylolpropane phosphite, triphenyl phosphite, tris(nonylphenyl) phosphite, tris(2,4-di-t-butylphenyl) phosphite, tetraphenyldipropylene glycol diphosphite, tetraphenyltetra(tridecyl) pentaerythritol tetraphosphite, tetra(tridecyl)-4,4'-isopropylidenediphenyl diphosphite, bis(tridecyl) pentaerythritol diphosphite, bis (nonylphenyl) pentaerythritol diphosphite, distearyl pentaerythritol diphosphite and hydrogenated bisphenol A pentaerythritol phosphite polymer.

The above anti-wear agents can be used singly or in combination of two or more kinds.

Of the above anti-wear agents, preferable are a neutral phosphate, a neutral phosphite and calcium borate. By the use of a neutral phosphate, a neutral phosphite or calcium borate, for a longer period of time, metal corrosion of a slide portion of a precision instrument such as a watch is not brought about, frictional wear of the slide portion can be prevented, and the precision instrument such as a watch can be stably operated.

In the grease composition for a precision instrument of the invention, the anti-wear agent (B) is contained in an amount of 0.1 to 20% by weight, preferably 1 to 10% by weight, more preferably 3 to 7% by weight, based on the total amount of the grease composition. When the anti-wear agent (B) is added in the above amount, frictional wear of a slide portion of a precision instrument such as a watch can be favorably prevented, and the precision instrument such as a watch can be stably operated.

(C) Solid Lubricant

Examples of the solid lubricants (C) for use in the invention include molybdenum disulfide and PTFE particles. The PTFE particles are preferably those having a primary particle diameter of 0.5 to 8 μm.

The above solid lubricants can be used singly or in combination of two or more kinds.

In the grease composition for a precision instrument of the invention, the solid lubricant (C) is desirably contained in an amount of 0.01 to 5% by weight, preferably 0.01 to 3% by weight, more preferably 0.3 to 1% by weight, based on the total amount of the grease composition. When the solid lubricant (C) is added in the above amount, frictional wear of a slide portion of a precision instrument such as a watch can be favorably prevented even if a part for the precision instrument has high extreme-pressure properties, and the precision instrument such as a watch can be stably operated.

(D) Metal Deactivator

The metal deactivator (D) for use in the invention is preferably benzotriazole or its derivative.

Examples of the benzotriazole derivatives include 2-(2'-hydroxy-5'-methylphenyl)benzotriazole, 2-[2'-hydroxy-3',5'-bis(α,α-dimethylbenzyl)phenyl]benzotriazole, 2-(2'-hydroxy-3',5'-di-t-butylphenyl)benzotriazole, compounds represented by the following formula (3), such as 1-(N,N-bis(2-ethylhexyl)aminomethyl)benzotriazole, and compounds represented by the following formula (4), (3)

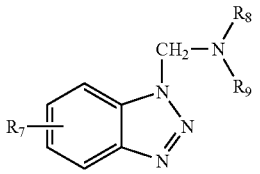

wherein $R_7$, $R_8$ and $R_9$ are each independently an alkyl group of 1 to 18 carbon atoms.

(4)

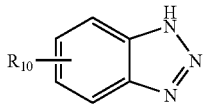

wherein $R_{10}$ is an alkyl group of 1 to 18 carbon atoms.

The above metal deactivators can be used singly or in combination of two or more kinds.

In the grease composition for a precision instrument of the invention, the metal deactivator (D) is desirably contained in an amount of 0.01 to 3% by weight, preferably 0.02 to 1% by weight, more preferably 0.03 to 0.06% by weight, based on the total amount of the grease composition. When the metal deactivator (D) is added in the above amount, corrosion of a metal such as copper can be favorably prevented.

(E) Antioxidant

The antioxidant (E) for use in the invention is preferably a phenol type antioxidant or an amine type antioxidant.

Examples of the phenol type antioxidants include 2,6-di-1-butyl-p-cresol, 2,4,6-tri-t-butylphenol and 4,4'-methylenebis(2,6-di-t-butylphenol).

Examples of the amine type antioxidants include diphenylamine derivatives.

The above antioxidants can be used singly or in combination or two or more kinds.

In the grease composition for a precision instrument of the invention, the antioxidant (E) is desirably contained in an amount of 0.01 to 3% by weight, preferably 0.01 to 2% by weight, more preferably 0.03 to 1.2% by weight, based on the total amount of the grease composition. When the antioxidant (E) is added in the above amount, change of properties of the grease composition and corrosion of a slide portion of a precision instrument such as a watch can be prevented over a long period of time.

<Grease Composition for Precision Instrument>

The grease composition for a precision instrument according to the invention contains (A) the lithium soap grease or the urea grease and (B) the anti-wear agent. When a sliding mechanism of a precision instrument such as a watch is assembled by the use of such a grease composition, a decrease ratio of the slip torque after a 10-years accelerated test can be lowered to not more than 15%. Herein, the decrease ratio of a slip torque (referred to as "torque decrease ratio" hereinafter) is defined as change (change ratio) of a slip torque after the 10-years accelerated test for adjusting time to that at the start of operation test for sliding mechanism.

The grease composition for a precision instrument of the invention further contains, if necessary, the solid lubricant (C). When a sliding mechanism of a precision instrument such as a watch is assembled by the use of such a grease composition, a decrease ratio of the slip torque can be lowered to not more than 9%. Further, when the grease composition for a precision instrument of the invention contains the metal deactivator (D) and the antioxidant (E), a decrease ratio of the slip torque at high temperature can be lowered to not more than 10%.

In the grease composition for a precision instrument of the invention, the change in weight (also referred to as "evaporation loss") of the lithium soap grease or urea grease, measured after the grease is held at 90° C. for 1000 hours, is desirably not more than 10% by weight, preferably not more than 5% by weight, more preferably not more than 1% by weight, particularly preferably not more than 0.5% by weight. When the change in weight of the grease, measured after the grease is held at 90° C. for 1000 hours, is not more than 10% by weight, a precision instrument using the grease composition containing such grease, such as a watch, exhibits excellent high-temperature operating stability.

The total acid number of the grease composition is desirably not more than 0.2 mgKOH/g. When the total acid number of the grease composition is not more than 0.2 mgKOH/g, corrosion of parts of a precision instrument such as a watch can be prevented.

<Watch>

A watch according to the invention is a watch in which the above-mentioned grease composition for a precision instrument is used in the slide portion. For example, the grease composition for a precision instrument is applied to a slip portion of a second wheel and pinion having a sliding mechanism. In the watch in which the grease composition for a precision instrument is used for a sliding mechanism, frictional wear of part(s) of the sliding mechanism can be inhibited, and the watch exhibits stable operating performance. Particularly in a watch wherein the grease composition for a precision instrument containing, as the anti-wear agent, a neutral phosphate, a neutral phosphite or calcium borate is used, frictional wear of part(s) of the sliding mechanism can be inhibited and the watch operates stably, over a long period of time.

When the grease composition for a precision instrument of the invention is used for a sliding mechanism of a slide portion of a watch and the lubricating oil composition is used for portions other than the sliding mechanism, preferred combinations of the grease composition and the lubricating oil composition are the following combinations (1) to (3).

(1) Grease composition: grease composition obtained from the polyol ester oil (a1)

Lubricating oil composition: lubricating oil composition obtained from the polyol ester oil (a1)

(2) Grease composition: grease composition obtained from the paraffinic hydrocarbon oil (a2)

Lubricating oil composition: lubricating oil composition obtained from the paraffinic hydrocarbon oil (a2)

(3) Grease composition: grease composition obtained from the ether oil (a3)

Lubricating oil composition: lubricating oil composition obtained from the ether oil (a3)

The lubricating oil composition used in the invention is not specifically restricted provided that the lubricating oil composition is a lubricating oil composition used for a watch and that the above combinations are satisfied.

By the use of the above combinations of the grease composition for a precision instrument and the lubricating oil composition in a watch, properties of the lubricating oil are not changed even when they are mixed with each other, and the watch can continuously operate more stably.

<Maintenance Method of Watch>

A maintenance method of a watch according to the invention is a maintenance method of a watch in which the grease composition for a precision instrument containing a solid lubricant is used for a sliding mechanism of a slide portion.

First, the watch assembled using the grease composition for a precision instrument containing a solid lubricant is disassembled and washed. Thereafter, when this watch is re-assembled, the grease composition for a precision instrument containing no solid lubricant is used for a sliding mechanism of a slide portion.

Even if the grease composition for a precision instrument containing no solid lubricant is used, a slip torque does not extremely decrease. Even after disassembly and washing, stable operating performance of the watch is obtained.

The grease composition for a precision instrument containing no solid lubricant is cheaper than the grease composition for a precision instrument containing a solid lubricant, so that the maintenance method of a watch of the invention is economically excellent.

EXAMPLES

<Measurement Method of Penetration (25° C.) of ¼-cone (JIS K2220) for Grease (A)>

The penetration (25° C.) of ¼-cone (JIS K2220) for the grease (A) for a specified time (0.1 seconds or 1 second) was measured by the use of the consistometer and ¼-cone (total amount of a holding bar and the cone: 9.38 g) as described in JIS K2220. In accordance with JIS K2220, the grease (A) was placed into a ¼-mixing pot, and the temperature of the grease (A) was maintained at 25° C. The grease (A) was sufficiently mixed to obtain a homogeneous sample. The pot in which the sample was placed was put on the stage of the consistometer, and then a tip of the ¼-cone was brought in contact with the center of a sample surface. Thereafter, a agrafe was pushed to penetrate the ¼-cone into the sample for specified time (0.1 seconds or 1 second). A reading of indicating gauge at the time was read, and was regarded as a penetration (25° C., unit: mm) of ¼-cone (JIS K2220) for the specified time.

<Preparation of Grease (A1)>

Greases (A1) used in Examples 1 to 6 and Comparative Examples 1 to 2 are given below.

(Lithium Soap Grease (A1-1))

Trimethylolpropane and valeric acid were mixed in a mixing ratio of 1:4 (trimethylolpropane:valeric acid) by mol to perform esterification reaction, whereby a crude trimethylolpropane-valeric acid ester was obtained. From the crude trimethylolpropane-valeric acid ester, a trimethylolpropane-valeric acid ester (a1-1) having no hydroxyl group in a molecule was separated by the use of Wakogel (available from Wako Pure Chemical Ind., Ltd.). By the measurement of an infrared absorption spectrum of the trimethylolpropane-valeric acid ester (a1-1), it was confirmed that no hydroxyl group was present in a molecule.

To the trimethylolpropane-valeric acid ester (a1-1), lithium stearate was added in an amount of not less than 10% by weight, and they were heated to not lower than the melting point of lithium stearate to obtain a lithium soap grease. Then, to the lithium soap grease, the trimethylolpropane-valeric acid ester (a1-1) was further added so that the penetration (25° C.) of ¼-cone (JIS K2220) for 0.1 seconds was 15.2 mm, to prepare a lithium soap grease (A1-1).

(Lithium Soap Grease (A1-2))

Trimethylolpropane and nonanoic acid were mixed in a mixing ratio of 1:4 (trimethylolpropane:nonanoic acid) by mol to perform esterification reaction, whereby a crude trimethylolpropane-nonanoic acid ester was obtained. From the crude trimethylolpropane-nonanoic acid ester, a trimethylolpropane-nonanoic acid ester (a1-2) having no hydroxyl group in a molecule was separated by the use of Wakogel (available from Wako Pure Chemical Ind., Ltd.). By the measurement of an infrared absorption spectrum of the trimethylolpropane-nonanoic acid ester (a1-2), it was confirmed that no hydroxyl group was present in a molecule.

To the trimethylolpropane-nonanoic acid ester (a1-2), lithium stearate was added in an amount of not less than 10% by weight, and they were heated to not lower than the melting point of lithium stearate to obtain a lithium soap grease. Then, to the lithium soap grease, the trimethylolpropane-nonanoic acid ester (a1-2) was further added so that the penetration (25° C.) of ¼-cone (JIS K2220) for 0.1 seconds was 13.0 mm, to prepare a lithium soap grease (A1-2).

(Lithium Soap Grease (A1-3))

Trimethylolpropane, decanoic acid and octanoic acid were mixed in a mixing ratio of 1:2:2 (trimethylolpropane: decanoic acid:octanoic acid) by mol to perform esterification reaction, whereby a crude trimethylolpropane-decanoic acid/octanoic acid mixed ester was obtained. From the crude trimethylolpropane-decanoic acid/octanoic acid mixed ester, a trimethylolpropane-decanoic acid/octanoic acid mixed ester (a1-3) having no hydroxyl group in a molecule was separated by the use of Wakogel (available from Wako Pure Chemical Ind., Ltd.). By the measurement of an infrared absorption spectrum of the trimethylolpropane-decanoic acid/octanoic acid mixed ester (a1-3), it was confirmed that no hydroxyl group was present in a molecule.

To the trimethylolpropane-decanoic acid/octanoic acid mixed ester (a1-3), lithium stearate was added in an amount of not less than 10% by weight, and they were heated to not lower than the melting point of lithium stearate to obtain a lithium soap grease. Then, to the lithium soap grease, the trimethylolpropane-decanoic acid/octanoic acid mixed ester (a1-3) was further added so that the penetration (25° C.) of ¼-cone (JIS K2220) for 0.1 seconds was 20.2 mm, to prepare a lithium soap grease (A1-3).

(Lithium Soap Grease (A1-4))

Trimethylolpropane and valeric acid were mixed in a mixing ratio of 1:2 (trimethylolpropane:valeric acid) by mol to perform esterification reaction, whereby a crude trimethylolpropane-valeric acid ester was obtained. From the crude trimethylolpropane-valeric acid ester, a trimethylolpropane-valeric acid ester (a1-4) having no hydroxyl group in a molecule was separated by the use of Wakogel (available from Wako Pure Chemical Ind., Ltd.). By the measurement of an infrared absorption spectrum of the trimethylolpropane-valeric acid ester (a1-4), it was confirmed that one hydroxyl group on the average was present in a molecule.

To the trimethylolpropane-valeric acid ester (a1-4), lithium stearate was added in an amount of not less than 10% by weight, and they were heated to not lower than the melting point of lithium stearate to obtain a lithium soap grease. Then, to the lithium soap grease, the trimethylolpropane-valeric acid ester (a1-4) was further added so.that the penetration (25° C.) of ¼-cone (JIS K2220) for 0.1 seconds was 14.0 mm, to prepare a lithium soap grease (A1-4).

(Urea Grease (A1-5))

Neopentyl glycol, decanoic acid and octanoic acid were mixed in a mixing ratio of 1:3:3 (neopentyl glycol:decanoic acid:octanoic acid) by mol to perform esterification reaction, whereby a crude neopentyl glycol-decanoic acid/octanoic acid mixed ester was obtained. From the crude neopentyl glycol-decanoic acid/octanoic acid mixed ester, a neopentyl glycol-decanoic acid/octanoic acid mixed ester (a1-5) having no hydroxyl group in a molecule was separated by the use of Wakogel (available from Wako Pure Chemical Ind., Ltd.). By the measurement of an infrared absorption spectrum of the neopentyl glycol-decanoic acid/octanoic acid mixed ester (a1-5), it was confirmed that no hydroxyl group was present in a molecule.

To the neopentyl glycol-decanoic acid/octanoic acid mixed ester (a1-5), a diurea compound (A) represented by the following formula was added in an amount of not less than 10% by weight, and they were heated to not lower than the melting point of the diurea compound (A) to obtain a urea grease.

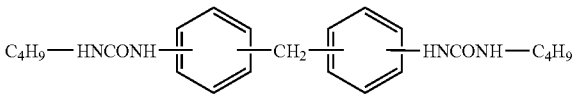

Then, to the urea grease, the neopentyl glycol-decanoic acid/octanoic acid mixed ester (a1-5) was further added so that the penetration (25° C.) of ¼-cone (JIS K2220) for 0.1 seconds was 18.3 mm, to prepare a urea grease (A1-5) The urea grease (A1-5) was held at 90° C. for 1000 hours. After that, a change in weight (evaporation loss) of the urea grease (A1-5) was measured, and as a result, the evaporation loss was 0.05% by weight.

(Urea Grease (A1-6))

Trimethylolpropane and decanoic acid were mixed in a mixing ratio of 1:4 (trimethylolpropane:decanoic acid) by mol to perform esterification reaction, whereby a crude trimethylolpropane-decanoic acid ester was obtained. From the crude trimethylolpropane-decanoic acid ester, a trimethylolpropane-decanoic acid ester (a1-6) having no hydroxyl group in a molecule was separated by the use of Wakogel (available from Wako Pure Chemical Ind., Ltd.). By the measurement of an infrared absorption spectrum of the trimethylolpropane-decanoic acid ester (a1-6), it was confirmed that no hydroxyl group was present in a molecule.

To the trimethylolpropane-decanoic acid ester (a1-6), a diurea compound (B) represented by the following formula was added in an amount of not less than 10% by weight, and they were heated to not lower than the melting point of the diurea compound (B) to obtain a urea grease.

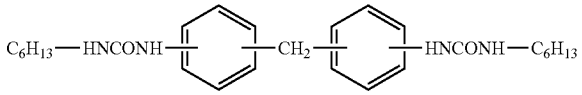

Then, to the urea grease, the trimethylolpropane-decanoic acid/octanoic acid mixed ester (a1-5) was further added so that the penetration (25° C.) of ¼-cone (JIS K2220) for 0.1 seconds was 16.1 mm, to prepare a urea grease (A1-6). The evaporation loss measured after the urea grease (A1-6) was held at 90° C. for 1000 hours was 0.08% by weight.

(Urea Grease (A1-7))

To the trimethylolpropane-nonanoic acid ester (a1-2) having no hydroxyl group in a molecule, the diurea compound (A) was added in an amount of not less than 10% by weight, and they were heated to not lower than the melting point of the diurea compound (A) to obtain a urea grease.

Then, to the urea grease, the trimethylolpropane-nonanoic acid ester (a1-2) was further added so that the penetration (25° C.) of ¼-cone (JIS K2220) for 0.1 seconds was 15.5 mm, to prepare a urea grease (A1-7). The evaporation loss measured after the urea grease (A1-7) was held at 90° C. for 1000 hours was 0.10% by weight.

Example 1

To the lithium soap grease (A1-1), trioleyl phosphate was added as an anti-wear agent in an amount of 1% by weight to prepare a lithium soap grease composition. The lithium soap grease composition was stored in an atmosphere of a temperature of 40° C. and a humidity of 95% for 1000 hours. Then, a percentage of moisture absorption of the lithium soap grease composition was measured.

Using the lithium soap grease composition, a watch movement (Citizen Watch #2035, train wheel portion: made of metal (mainly made of brass and iron)) was assembled. Then, corrosion of the sliding mechanism of the slide portion was examined. The results are set forth in Table 1.

Comparative Example 1

A lithium soap grease composition was prepared in the same manner as in Example 1, except that the lithium soap grease (A1-4) was used instead of the lithium soap grease (A1-1). Then a percentage of moisture absorption of the lithium soap grease composition was measured in the same manner as in Example 1.

For the lithium soap grease composition, corrosion of the sliding mechanism of the slide portion was examined in the same manner as in Example 1. The results are set forth in Table 1.

TABLE 1

| Grease | Percentage of moisture absorption | Corrosion |
|---|---|---|
| Lithium soap grease (A-1) | 0.1% by weight | not corroded |
| Lithium soap grease (A-4) | 8.9% by weight | tarnished |

Example 2

To the urea grease (A1-5), anti-wear agents shown in Table 2 were each added in an amount of every 0.05% by weight within the range of 0.1 to 30% by weight to prepare urea grease compositions. Using the urea grease compositions, watch movements (Citizen Watch #2035, train wheel portion: made of metal (mainly made of brass and iron)) were assembled. Then, operation confirmation test was carried out in the following manner. The results are set forth in Table 2.

(Operation Confirmation Test)

A crown was pulled to cause the watch to be in a state of adjusting time. The crown was rotated in the time-advancing direction and-the time-returning direction alternately to make time-adjusting operations corresponding to those of a total of 10 years. Then, a ratio of the torque measured after the time-adjusting operations to the torque measured before the time-adjusting operations, namely, torque decrease ratio, was determined.

Comparative Example 2

Urea grease compositions were prepared in the same manner as in Example 2, except that the anti-wear agents shown in Table 2 were each added in an amount of 0% by weight or 0.05% by weight to the urea grease (A1-5). Using the urea grease compositions, watch movements were assembled and operation confirmation tests of the watch movements were carried out, in the same manner as in Example 2. The results are set forth in Table 2.

TABLE 2

| Anti-wear agent | Amount added (wt %) | Corrosion | Torque decrease ratio | Overall judgment |
|---|---|---|---|---|
| Zinc diethyldithiophosphate | 0 | — | C | C |
| | 0.05 | B | C | C |
| | 0.1~30 | B | A | B |
| Distearyl sulfide | 0 | — | C | C |
| | 0.05 | B | C | C |
| | 0.1~30 | B | A | B |
| Tricresyl phosphate | 0 | — | C | C |
| | 0.05 | A | C | C |
| | 0.1~30 | A | A | A |
| Lauryl acid phosphate | 0 | — | C | C |
| | 0.05 | A | C | C |
| | 0.1~30 | B | A | B |
| Trioleyl phosphite | 0 | — | C | C |
| | 0.05 | A | C | C |
| | 0.1~30 | A | A | A |
| Dilauryl hydrogenphosphite | 0 | — | C | C |
| | 0.05 | A | C | C |
| | 0.1~30 | B | A | B |
| Lauryl acid phosphate diethylamine salt | 0 | — | C | C |
| | 0.05 | A | C | C |
| | 0.1~30 | B | A | B |

TABLE 2-continued

| Anti-wear agent | Amount added (wt %) | Corrosion | Torque decrease ratio | Overall judgment |
|---|---|---|---|---|
| Calcium borate | 0 | — | C | C |
| | 0.05 | A | C | C |
| | 0.1~30 | A | A | A |

(Evaluation)
Corrosion:
A: The metal part was free from corrosion, change of appearance and change of properties.
B: The metal part was a little corroded.
C: The metal part was markedly corroded.
Torque decrease ratio:
A: The torque decrease ratio was in the range of about 10 to 15%.
B: The torque decrease ratio was more than 15%.
C: A marked decrease was found in the initial stage of the operation confirmation test.
Overall judgment:
A: The watch movement is employable for a long period of time.
B: The watch movement is employable for a short period of time.
C: The watch movement is difficult to use.

According to Table 2, when the amount of the anti-wear agent added was less than 0.1% by weight, marked decrease of torque was found in any of the anti-wear agents in the initial stage of the operation confirmation test. Further, as the amount of the anti-wear agent added was increased, the torque decrease ratio was lowered, but when the amount thereof exceeded 20% by weight, the torque decrease ratio was almost constant at about 10%. Hence, it has been confirmed that taking economical efficiency into consideration, the amount of the anti-wear agent added is preferably in the range of 0.1 to 20% by weight.

Example 3

To the lithium soap grease (A1-2), trixylenyl phosphate was.added as an anti-wear agent in an amount of 2% by weight to prepare a lithium soap grease composition. Separately, to the lithium soap grease composition, PTFE particles (particle diameter: 0.5 to 8 μm) or molybdenum disulfide was added as a solid lubricant in an amount of every 0.05% by weight within the range of 0.01 to 10% by weight to prepare lithium soap grease compositions containing a solid lubricant. Using the lithium soap grease compositions, watch movements were assembled and operation confirmation tests of the watch movements were carried out, in the same manner as in Example 2. The results are set forth in Table 3.

TABLE 3

| Solid lubricant | Amount added (wt %) | Torque decrease ratio |
|---|---|---|
| PTFE particle | 0 | 9.5% |
| | 0.01~10 | 9~5% |
| Molybdenum disulfide | 0 | 9.5% |
| | 0.01~10 | 9~5% |

With increase of the amount of the solid lubricant added, the torque decrease ratio was lowered, but when the amount thereof exceeded 5% by weight, the torque decrease ratio was almost constant at about 5%. Hence, it has been confirmed that taking economical efficiency into consideration, the amount of the anti-wear agent added is preferably in the range of 0.01 to 5% by weight.

Example 4

To the lithium soap grease (A1-3), trioleyl phosphite was added as an anti-wear agent in an amount of 5% by weight to prepare a lithium soap grease composition. Separately, to the lithium soap grease composition, 0.05% by weight of benzotriazole as a metal deactivator and 0.05% by weight of a diphenylamine derivative as an antioxidant were added to prepare a lithium soap grease composition containing a metal deactivator and an antioxidant. Using the lithium soap grease compositions, watch movements were assembled in the same manner as in Example 2. Then, operation confirmation test was carried out in the same manner as in Example 2, except that high-temperature operation confirmation test at 80° C. was added. The results are set forth in Table 4.

TABLE 4

| | | |
|---|---|---|
| Benzotriazole | 0 wt % | 0.05 wt % |
| Diphenylamine derivative | 0 wt % | 0.05 wt % |
| Torque decrease ratio | | |
| Ordinary temperature | 7.5% | 7.5% |
| 80° C. | 32.4% | 9.5% |
| Corrosion | | |
| Ordinary temperature | not corroded | not corroded |
| 80° C. | corroded | not corroded |

Example 5

To each of the urea greases (A1-5) to (A1-7), tristearyl phosphate was added as an anti-wear agent in an amount of 5% by weight to prepare urea grease compositions. Using the urea grease compositions, watch movements were assembled in the same manner as in Example 2. The watch movements were stored. at a high temperature of 80° C. Then, operation confirmation test was carried out in the same manner as in Example 2. The results are set forth in Table 5.

TABLE 5

| Urea grease | Evaporation loss (after stored at 90° C. for 1000 hrs) | Torque decrease ratio |
|---|---|---|
| Urea grease (A1-5) | 0.05 wt % | 4.5% |
| Urea grease (A1-6) | 0.08 wt % | 5.0% |
| Urea grease (A1-7) | 0.10 wt % | 4.8% |

Example 6

To the lithium soap grease (A1-3), trioleyl phosphite was added as an anti-wear agent in an amount of 5% by weight to prepare lithium soap grease compositions. The lithium soap grease compositions had total acid numbers of 0.1 to 3 mgKQH/g. Separately, to each of the lithium soap grease compositions, 0.05% by weight of benzotriazole as a metal deactivator and 0.05% by weight of a diphenylamine derivative as an antioxidant were added to prepare lithium soap grease compositions containing a metal deactivator and an antioxidant.

Using the lithium soap grease compositions, watch movements were assembled and operation confirmation tests of the watch movements were carried out, in the same manner as in Example 2. The results are set forth in Table 6.

TABLE 6

| Total acid number (mgKOH/g) | Appearance of metal part: in the initial stage of operation confirmation test | Appearance of metal part: After operation confirmation test | Overall judgment |
|---|---|---|---|
| 0 to 0.2 | Acceptable | Acceptable | A |
| more than 0.2 | Acceptable | Corroded and tarnish | B |

(Evaluation)
Overall judgment:
A: The watch movement is employable for a long period of time.
B: The watch movement is employable for a short period of time.
C: The watch movement is difficult to use.

<Preparation of Grease (A2)>

Greases (A2) used in Examples 7 to 12 and Comparative Example 3 are given below.

(Lithium Soap Grease (A2-1))

To trimer of 1-decene, lithium stearate was added in an amount of not less than 10% by weight, and they were heated to not lower than the melting point of lithium stearate to obtain a lithium soap grease. Then, to the lithium soap grease, the trimer of 1-decene was further added so that the penetration (25° C.) of ¼-cone (JIS K2220) for 0.1 seconds was 15.0 mm, to prepare a lithium soap grease (A2-1).

(Lithium Soap Grease (A2-2))

To tetramer of 1-decene, lithium stearate was added in an amount of not less than 10% by weight, and they were heated to not lower than the melting point of lithium stearate to obtain a lithium soap grease. Then, to the lithium soap grease, the tetramer of 1-decene was further added so that the penetration (25° C.) of ¼-cone (JIS K2220) for 0.1 seconds was 20.5 mm, to prepare a lithium soap grease (A2-2).

(Lithium Soap Grease (A2-3))

To trimer of 1-undecene, lithium stearate was added in an amount of not less than 10% by weight, and they were heated to not lower than the melting point of lithium stearate to obtain a lithium soap grease. Then, to the lithium soap grease, the trimer of 1-undecene was further added so that the penetration (25° C.) of ¼-cone (JIS K2220) for 0.1 seconds was 15.8 mm, to prepare a lithium soap grease (A2-3).

(Lithium Soap Grease (A2-4))

To trimer of 1-dodecene, lithium stearate was added in an amount of not less than 10% by weight, and they were heated to not lower than the melting point of lithium stearate to obtain a lithium soap grease. Then, to the lithium soap grease, the trimer of 1-dodecene was further added so that the penetration (25° C.) of ¼-cone (JIS K2220) for 0.1 seconds was 17.5 mm, to prepare a lithium soap grease (A2-4).

(Urea Grease (A2-5))

To trimer of 1-decene, the diurea compound (A) was added in an amount of not less than 10% by weight, and they were heated to not lower than the melting point of the diurea compound (A) to obtain a urea grease. Then, to the urea grease, the trimer of 1-decene was further added so that the penetration (25° C.) of ¼-cone (JIS K2220) for 0.1 seconds was 21.1 mm, to prepare a urea grease (A2-5). The evaporation loss measured after the urea grease (A2-5) was held at 90° C. for 1000 hours was 0.07% by weight.

(Urea Grease (A2-6))

To trimer of 1-decene, the diurea compound (B) was added in an amount of not less than 10% by weight, and they were heated to not lower than the melting point of the diurea compound (B) to obtain a urea grease. Then, to the urea grease, the trimer of 1-decene was further added so that the penetration (25° C.) of ¼-cone (JIS K2220) for 0.1seconds was 17.5 mm, to prepare a urea grease (A2-6). The evaporation loss measured after the urea grease (A2-6) was held at 90° C. for 1000 hours was 0.06% by weight.

(Urea Grease (A2-7))

To trimer of 1-undecene, a diurea compound (C) represented by the following formula was added in an amount of not less than 10% by weight, and they were heated to not lower than the melting point of the diurea compound (C) to obtain a urea grease.

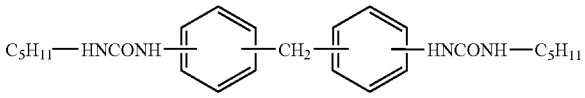

Then, to the urea grease, the trimer of 1-decene was further added so that the penetration (25° C.) of ¼-cone (JIS K2220) for 0.1 seconds was 14.5 mm, to prepare a urea grease (A2-7). The evaporation loss measured after the urea grease (A2-7) was held at 90° C. for 1000 hours was 0.07% by weight.

Example 7

To each of the lithium soap greases (A2-1) and (A2-2), trioleyl phosphate was added as an anti-wear agent in an amount. of 1% by weight to prepare lithium soap grease compositions. Using the lithium soap grease compositions, watch movements were assembled in the same manner as in Example 2. The watch movements were stored at a high temperature of 80° C. Then, operation confirmation test was carried out in the same manner as in Example 2. The results are set forth in Table 7.

TABLE 7

| Grease | Number of carbon in hydrocarbon oil | Torque decrease ratio |
|---|---|---|
| Lithium soap grease (A2-1) | 30 | 10.8% |
| Lithium soap grease (A2-2) | 40 | 10.2% |

Example 8

To the urea grease (A2-5), anti-wear agents shown in Table 8 were each added in an amount of every 0.05% by weight within the range of 0.1 to 30% by weight to prepare urea grease compositions. Using the urea grease compositions, watch movements were assembled and operation confirmation tests of the watch movements were carried out, in the same manner as in Example 2. The results are set forth in Table 8.

Comparative Example 3

Urea grease compositions were prepared in the same manner as in Example 8, except that the anti-wear agents shown in Table 8 were each added in an amount of 0% by weight or 0.05% by weight to the urea grease (A2-5). Using the urea grease compositions, watch movements were assembled and operation confirmation tests of the watch movements were carried out, in the same manner as in Example 8. The results are set forth in Table 8.

TABLE 8

| Anti-wear agent | Amount added (wt %) | Corrosion | Torque decrease ratio | Overall judgment |
|---|---|---|---|---|
| Zinc diethyldithiophosphate | 0 | — | C | C |
| | 0.05 | B | C | C |
| | 0.1~30 | B | A | B |
| Distearyl sulfide | 0 | — | C | C |
| | 0.05 | B | C | C |
| | 0.1~30 | B | A | B |
| Tricresyl phosphate | 0 | — | C | C |
| | 0.05 | A | C | C |
| | 0.1~30 | A | A | A |
| Lauryl acid phosphate | 0 | — | C | C |
| | 0.05 | A | C | C |
| | 0.1~30 | B | A | B |
| Trioleyl phosphite | 0 | — | C | C |
| | 0.05 | A | C | C |
| | 0.1~30 | A | A | A |
| Dilauryl hydrogenphosphite | 0 | — | C | C |
| | 0.05 | A | C | C |
| | 0.1~30 | B | A | B |
| Lauryl acid phosphate diethylamine salt | 0 | — | C | C |
| | 0.05 | A | C | C |
| | 0.1~30 | B | A | B |
| Calcium borate | 0 | — | C | C |
| | 0.05 | A | C | C |
| | 0.1~30 | A | A | A |

(Evaluation)
Corrosion:
A: The metal part was free from corrosion, change of appearance and change of properties.
B: The metal part was a little corroded.
C: The metal part was markedly corroded.
Torque decrease ratio:
A: The torque decrease ratio was in the range of about 10 to 15%.
B: The torque decrease ratio was more than 15%.
C: A marked decrease was found in the initial stage of the operation confirmation test.
Overall judgment:
A: The watch movement is employable for a long period of time.
B: The watch movement is employable for a short period of time.
C: The watch movement is difficult to use.

According to Table 8, when the amount of the anti-wear agent added was less than 0.1% by weight, marked decrease of torque was found in any of the anti-wear agents in the initial stage of the operation confirmation test. Further, as the amount of the anti-wear agent added was increased, the torque decrease ratio was lowered, but when the amount thereof exceeded 20% by weight, the torque decrease ratio was almost constant at about 10%. Hence, it has been confirmed that taking economical efficiency into consideration, the amount of the anti-wear agent added is preferably in the range of 0.1 to 20% by weight.

Example 9

To the lithium soap grease (A2-3), trixylenyl phosphate was added as an anti-wear agent in an amount of 2% by weight to prepare a lithium soap grease composition. Separately, to the lithium soap grease composition, PTFE particles (particle diameter: 0.5 to 8 μm) or molybdenum disulfide was added as a solid lubricant in an amount of every 0.05% by weight within the range of 0.01 to 10% by weight to prepare lithium soap grease compositions containing a solid lubricant. Using the lithium soap grease compositions, watch movements were assembled and operation confirmation tests of the watch movements were carried out, in the same manner as in Example 2. The results are set forth in Table9.

TABLE 9

| Solid lubricant | Amount added (wt %) | Torque decrease ratio |
|---|---|---|
| PTFE particle | 0 | 9.7% |
| | 0.01~10 | 9~5% |
| Molybdenum disulfide | 0 | 10.0% |
| | 0.01~10 | 9~5% |

With increase of the amount of the solid lubricant added, the torque decrease ratio was lowered, but when the amount thereof exceeded 5% by weight, the torque decrease ratio was almost constant at about 5%. Hence, it has been confirmed that taking economical efficiency into consideration, the amount of the anti-wear agent added is preferably in the range of 0.01 to 5% by weight.

Example 10

To the lithium soap. grease (A2-4), trioleyl phosphite was added as an anti-wear agent in an amount of 5% by weight to prepare a lithium soap grease composition. Separately, to the lithium soap grease composition, 0.05% by weight of benzotriazole as a metal deactivator and 0.05% by weight of a diphenylamine derivative as an antioxidant were added to prepare a lithium soap grease composition containing a metal deactivator and an antioxidant. Using the lithium soap grease compositions, watch movements were assembled in the same manner as in Example 2. Then, operation confirmation test was carried out in the same manner as in Example 2, except that high-temperature operation confirmation test at 80° C. was added. The results are set forth in Table 10.

TABLE 10

| | | |
|---|---|---|
| Benzotriazole | 0 wt % | 0.05 wt % |
| Diphenylamine derivative | 0 wt % | 0.05 wt % |
| Torque decrease ratio | | |
| Ordinary temperature | 7.5% | 6.5% |
| 80° C. | 35.8% | 8.9% |
| Corrosion | | |
| Ordinary temperature | not corroded | not corroded |
| 80° C. | corroded | not corroded |

Example 11

To each of the urea greases (A2-5) to (A2-7), tristearyl phosphate was added as an anti-wear agent in an amount of 5% by weight to prepare urea grease compositions. Using the urea grease compositions, watch movements were assembled in the same manner as in Example 2. The watch 15 movements were stored at a high temperature of 80° C. Then, operation confirmation test was carried out in the same manner as in Example 2. The results are set forth in Table 11

TABLE 11

| Urea grease | Evaporation loss (after stored at 90° C. for 1000 hrs) | Torque decrease ratio |
|---|---|---|
| Urea grease (A2-5) | 0.07 wt % | 9.5% |
| Urea grease (A2-6) | 0.06 wt % | 12.1% |
| Urea grease (A2-7) | 0.07 wt % | 11.3% |

Example 12

To the lithium soap grease (A2-3), trioleyl phosphite was added as an anti-wear agent in an amount of 5% by weight to prepare lithium soap grease compositions. The lithium soap grease compositions had total acid numbers of 0.1 to 3 mgKOH/g. Separately, to each of the lithium soap grease compositions, 0.05% by weight of benzotriazole as a metal deactivator and 0.05% by weight of a diphenylamine derivative as an antioxidant were added to prepare lithium soap grease compositions containing a metal deactivator and an antioxidant.

Using the lithium soap grease compositions, watch movements were assembled and operation confirmation tests of the watch movements were carried out, in the same manner as in Example 2. The results are set forth in Table 12.

TABLE 12

| Total acid number (mgKOH/g) | Appearance of metal part: in the initial stage of operation confirmation test | Appearance of metal part: After operation confirmation test | Overall judgment |
|---|---|---|---|
| 0 to 0.2 | Acceptable | Acceptable | A |
| more than 0.2 | Acceptable | Corroded and tarnish | B |

(Evaluation)
Overall judgment:
A: The watch movement is employable for a long period of time.
B: The watch movement is employable for a short period of time.
C: The watch movement is difficult to use.

<Preparation of Grease (A3)>

Greases (A3) used in Examples 13 to 18 and Comparative Examples 4 to 5 are given below.

(Lithium Soap Grease (A3-1))

To an ether oil (a3-1) represented by the following formula,

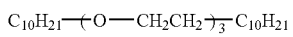

lithium stearate was added in an amount of not less than 10% by weight, and they were heated to not lower than the melting point of lithium stearate to obtain a lithium soap grease. Then, to the lithium soap grease, the ether oil (a3-1) was further added so that the penetration (25° C.) of ¼-cone (JIS K2220) for 0.1 seconds was 15.2 mm, to prepare a lithium soap grease (A3-1).

(Lithium Soap Grease (A3-2))

To an ether oil (a3-2) represented by the following formula,

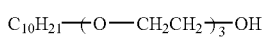

lithium stearate was added in an amount of not less than 10% by weight, and they were heated to not lower than the melting point of lithium stearate to obtain a lithium soap grease. Then, to the lithium soap grease, the ether oil (a3-2) was further added so that the penetration (25° C.) of ¼-cone (JIS K2220) for 0.1 seconds was 17.1 mm, to prepare a lithium soap grease (A3-2).

(Urea Grease (A3-3))

To an ether oil (a3-3) represented by the following formula,

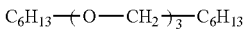

a diurea compound (D) represented by the following formula was added in an amount of not less than 10% by weight, and they were heated to not lower than the melting point of the diurea compound (D) to obtain a urea grease.

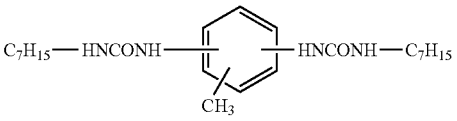

Then, to the urea grease, the ether oil (a3-3) was further added so that the penetration (25° C.) of ¼-cone (JIS K2220) for 0.1 seconds was 15.5 mm, to prepare a urea grease (A3-3). The evaporation loss measured after the urea grease (A3-3) was held at 90° C. for 1000 hours was 0.05% by weight.

(Urea Grease (A3-4))

To an ether oil (a3-4) represented by the following formula, a diurea compound (E) represented by the following formula was added in an amount of not less than 10% by weight, and they were heated to not lower than the melting point of the diurea compound (E) to obtain a urea grease.

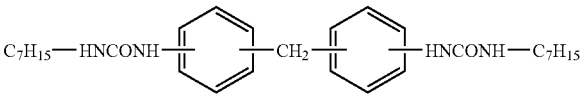

Then, to the urea grease, the ether oil (a3-4) was further added so that the penetration (25° C.) of ¼-cone (JIS K2220) for 0.1 seconds was 15.8 mm, to prepare a urea grease (A3-4). The evaporation-loss measured after the urea grease (A3-4) was held at 90° C. for 1000 hours was 0.11% by weight.

(Urea Grease (A3-5))

To an ether oil (a3-5) represented by the following formula,

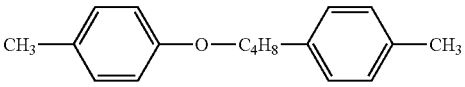

the diurea compound (A) was added in an amount of not less than 10% by weight, and they were heated to not lower than the melting point of the diurea compound (A) to obtain a urea grease.

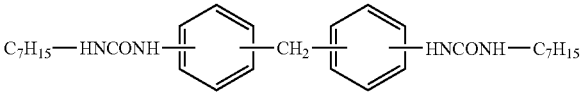

Then, to the urea grease, the ether oil (a3-5) was further added so that the penetration (25° C.) of ¼-cone (JIS K2220) for 0.1 seconds was 20.1 mm, to prepare a urea grease (A3-5). The evaporation loss measured after the urea grease (A3-5) was held at 90° C. for 1000 hours was 0.11% by weight.

Example 13

To the lithium soap grease (A3-1), trioleyl phosphate was added as an anti-wear agent in an amount of 1% by weight to prepare a lithium soap grease composition. The lithium soap grease composition was stored in an atmosphere of a temperature of 40° C. and a humidity of 95% for 1000 hours. Then, a percentage of moisture absorption of the lithium soap grease composition was measured.

Using the lithium soap grease composition, a watch movement (Citizen Watch #2035, train wheel portion: made of metal (mainly made of brass and iron)) was assembled. Then, corrosion of the sliding mechanism of the slide portion was examined. The results are set forth in Table 13.

Comparative Example 4

A lithium soap grease composition was prepared in the same manner as in Example 1, except that the lithium soap grease (A3-2) was used instead of the lithium soap grease (A3-1). Then a percentage of moisture absorption of the lithium soap grease composition was measured in the same manner as in Example 13.

For the lithium soap grease composition, corrosion of the sliding mechanism of the slide portion was examined in the same manner as in Example 13. The results are set forth in Table 13.

TABLE 13

| Grease | Percentage of moisture absorption | Corrosion |
|---|---|---|
| Lithium soap grease (A-1) | 0.3% by weight | not corroded |
| Lithium soap grease (A-4) | 7.8% by weight | tarnished |

Example 14

To the urea grease (A3-3), anti-wear agents shown in Table 14 were each added in an amount of every 0.05% by weight within the range of 0.1 to 30% by weight to prepare urea grease compositions. Using the urea grease compositions, watch movements were assembled and operation confirmation tests of the watch movements were carried out, in the same manner as in Example 2. The results are set forth in Table 14.

Comparative Example 5

Urea grease compositions were prepared in the same manner as in Example 14, except that the anti-wear agents shown in Table 14 were each added in an amount of 0% by weight or 0.05% by weight to the urea grease (A3-3). Using the urea grease compositions, watch movements were assembled and operation confirmation tests of the watch movements were carried out, in the same manner as in Example 14. The results are set forth in Table 14.

TABLE 14

| Anti-wear agent | Amount added (wt %) | Corrosion | Torque decrease ratio | Overall judgment |
|---|---|---|---|---|
| Zinc diethyldithiophosphate | 0 | — | C | C |
| | 0.05 | B | C | C |
| | 0.1~30 | B | A | B |
| Distearyl sulfide | 0 | — | C | C |
| | 0.05 | B | C | C |
| | 0.1~30 | B | A | B |
| Tricresyl phosphate | 0 | — | C | C |
| | 0.05 | A | C | C |
| | 0.1~30 | A | A | A |
| Lauryl acid phosphate | 0 | — | C | C |
| | 0.05 | A | C | C |
| | 0.1~30 | B | A | B |
| Trioleyl phosphite | 0 | — | C | C |
| | 0.05 | A | C | C |
| | 0.1~30 | A | A | A |
| Dilauryl hydrogenphosphite | 0 | — | C | C |
| | 0.05 | A | C | C |
| | 0.1~30 | B | A | B |
| Lauryl acid phosphate diethylamine salt | 0 | — | C | C |
| | 0.05 | A | C | C |
| | 0.1~30 | B | A | B |
| Calcium borate | 0 | — | C | C |
| | 0.05 | A | C | C |
| | 0.1~30 | A | A | A |

(Evaluation)
Corrosion:
A: The metal part was free from corrosion, change of appearance and change of properties.
B: The metal part was a little corroded.
C: The metal part was markedly corroded.
Torque decrease ratio:
A: The torque decrease ratio was in the range of about 10 to 15%.
B: The torque decrease ratio was more than 15%.
C: A marked decrease was found in the initial stage of the operation confirmation test.
Overall judgment:
A: The watch movement is employable for a long period of time.
B: The watch movement is employable for a short period of time.
C: The watch movement is difficult to use.

According to Table 14, when the amount of the anti-wear agent added was less than 0.1% by weight, marked decrease of torque was found in any of the anti-wear agents in the initial stage of the operation confirmation test. Further, as the amount of the anti-wear agent added was increased, the torque decrease ratio was lowered, but when the amount thereof exceeded 20% by weight, the torque decrease ratio was almost constant at about 10%. Hence, it has been confirmed that taking economical efficiency into consideration, the amount of the anti-wear agent added is preferably in the range of 0.1 to 20% by weight.

Example 15

To the lithium soap grease (A3-1), trixylenyl phosphate was added as an anti-wear agent in an amount of 2% by weight to prepare a lithium soap grease composition. Separately, to the lithium soap grease composition, PTFE particles (particle diameter: 0.5 to 8 μm) or molybdenum disulfide was added as a solid lubricant in an amount of every 0.05% by weight within the range of 0.01 to 10% by weight to prepare lithium soap grease compositions containing a solid lubricant. Using the lithium soap grease compositions, watch movements were assembled and operation confirmation tests of the watch movements were carried out, in the same manner as in Example 2. The results are set forth in Table 15.

TABLE 15

| Solid lubricant | Amount added (wt %) | Torque decrease ratio |
|---|---|---|
| PTFE particle | 0 | 10.3% |
| | 0.01~10 | 9~5% |
| Molybdenum disulfide | 0 | 10.3% |
| | 0.01~10 | 9~5% |

With increase of the amount of the solid lubricant added, the torque decrease ratio was lowered, but when the amount thereof exceeded 5% by weight, the torque decrease ratio was almost constant at about 5%. Hence, it has been confirmed that taking economical efficiency into consideration, the amount of the anti-wear agent added is preferably in the range of 0.01 to 5% by weight.

Example 16

To the lithium soap grease (A3-1), trioleyl phosphite was added as an anti-wear agent in an amount of 5% by weight to prepare a lithium soap grease composition. Separately, to the lithium soap grease composition, 0.05% by weight of benzotriazole as a metal deactivator and 0.05% by weight of a diphenylamine derivative as an antioxidant were added to prepare a lithium soap grease composition containing a metal deactivator and an antioxidant. Using the lithium soap grease compositions, watch movements were assembled in the same manner as in Example 2. Then, operation confirmation test was carried out in the same manner as in Example 2, except that high-temperature operation confirmation test at 80° C. was added. The results are set forth in Table 16.

TABLE 16

| | | |
|---|---|---|
| Benzotriazole | 0 wt % | 0.05 wt % |
| Diphenylamine derivative | 0 wt % | 0.05 wt % |
| Torque decrease ratio | | |
| Ordinary temperature | 7.3% | 7.0% |
| 80° C. | 35.4% | 9.7% |
| Corrosion | | |
| Ordinary temperature | not corroded | not corroded |
| 80° C. | corroded | not corroded |

Example 17

To each of the urea greases (A3-3) to (A3-5), tristearyl phosphate was added as an anti-wear agent in an amount of 5% by weight to prepare urea grease compositions. Using the urea grease compositions, watch movements were assembled in the same manner as in Example 2. The watch movements were stored at a high temperature of 80° C. Then, operation confirmation test was carried out in the same manner as in Example 2. The results are set forth in Table 17.

TABLE 17

| Urea grease | Evaporation loss (after stored at 90° C. for 1000 hrs) | Torque decrease ratio |
|---|---|---|
| Urea grease (A3-3) | 0.05 wt % | 9.4% |
| Urea grease (A3-4) | 0.11 wt % | 11.1% |
| Urea grease (A3-5) | 0.11 wt % | 10.8% |

Example 18

To the lithium soap grease (A3-1), trioleyl phosphite was added as an anti-wear agent in an amount of 5% by weight to prepare lithium soap grease compositions. The lithium soap grease compositions had total acid numbers of 0.1 to 3 mgKOH/g. Separately, to each of the lithium soap grease compositions, 0.05% by weight of benzotriazole as a metal deactivator and 0.05% by weight of a diphenylamine derivative as an antioxidant were added to prepare lithium soap grease compositions containing a metal deactivator and an antioxidant.

Using the lithium soap grease compositions, watch movements were assembled and operation confirmation tests of the watch movements were carried out, in the same manner as in Example 2. The results are set forth in Table 18.

TABLE 18

| Total acid number (mgKOH/g) | Appearance of metal part: in the initial stage of operation confirmation test | Appearance of metal part: After operation confirmation test | Overall judgment |
|---|---|---|---|
| 0 to 0.2 | Acceptable | Acceptable | A |
| more than 0.2 | Acceptable | Corroded and tarnish | B |

(Evaluation)
Overall judgment:
A: The watch movement is employable for a long period of time.
B: The watch movement is employable for a short period of time.
C: The watch movement is difficult to use.

Example 19

To each of ether oils, lithium stearate was added in an amount of not less than 10% by weight, and they were heated to not lower than the melting point of lithium stearate to obtain lithium soap greases. Then, to each of the lithium soap greases, the ether oil was further added so that the penetration (25° C.) of ¼-cone (JIS K2220) for 0.1 seconds was 18.4 mm, to prepare lithium soap greases. The ether oil used in this Example is represented by the following formula:

$$R_1-(O-R_2)_n-R_3$$

wherein $R_1$ and $R_3$ are each independently an alkyl group of 1 to 18 carbon atoms or a monovalent aromatic hydrocarbon group of 6 to 18 carbon atoms, $R_2$ is an alkylene group of 1 to 18 carbon atoms or a divalent aromatic hydrocarbon group of 6 to 18 carbon atoms, and n is an integer of 1 to 5.

To each of the lithium soap greases, trioleyl phosphate was added as an anti-wear agent in an amount of 1% by weight to prepare lithium soap grease compositions. Using the lithium soap grease compositions, watch movements were assembled in the same manner as in Example 2. The watch movements were stored at a high temperature of 80° C. Then, operation confirmation test was carried out in the same manner as in Example 2. As a result, in any of the grease compositions, torque decrease ratios were about 10 to 15%, and the watch was favorably operated.

Example 20

Lubricating oil compositions and grease compositions used in this Example are given below.

(Polyol Ester Type Lubricating Oil Composition)

To the trimethylolpropane-valeric acid ester (a1-1), 2% by weight of polymethylmethacrylate (available from Sanyo Chemical Ind., Ltd., trade name: ACLUBE) as a viscosity index improver and 5% by weight of trioleyl phosphate as an anti-wear agent was added to prepare a lubricating oil composition containing a polyol ester.

(Hydrocarbon Type Lubricating Oil Composition)

To a trimer of 1-decene, 3% by weight of polyolefin (available from Mitsui Chemicals, Inc., trade name: LUCANT) as a viscosity index improver and 5% by weight of trioleyl phosphate as an anti-wear agent was added to prepare a lubricating oil composition containing a hydrocarbon.

(Ether Type Lubricating Oil Composition)

To the ether oil (a3-1), 2.5% by weight of polymethylmethacrylate (available from Sanyo Chemical Ind., Ltd., trade name: ACLUBE) as a viscosity index improver and 5% by weight of trioleyl phosphate as an anti-wear agent was added to prepare a lubricating oil composition containing an ether oil.

(Polyol Ester Type Grease Composition)

To the lithium soap grease (A1-1), trioleyl phosphate was added as an anti-wear agent in an amount of 1% by weight to prepare a polyol ester type grease composition.

(Hydrocarbon Type Grease Composition)

To the lithium soap grease (A2-1), trioleyl phosphate was added as an anti-wear agent in an amount of 1% by weight to prepare a hydrocarbon type grease composition.

(Ether Type Grease Composition)

To the lithium soap grease (A3-1), trioleyl phosphate was added as an anti-wear agent in an amount of 1% by weight to prepare an ether type grease composition.

(Assembly of Watch)

Each of the grease compositions was applied to a sliding mechanism of a slide portion in watch movements (Citizen Watch #2035, train wheel portion: made of metal (mainly made of brass and iron)). Each of the lubricating compositions was applied to a slide portion other than the sliding mechanism. Then, watches were assembled the watch movements.

A crown was pulled to cause the watch to be in a state of adjusting time. The crown was continuously rotated for 2 hours. The results are set forth in Table 19.

TABLE 19

| | | Lubricating oil composition | | |
|---|---|---|---|---|
| | | Polyol ester type | Hydrocarbon type | Ether type |
| Grease composition | Polyol ester type | A | B | B |
| | Hydrocarbon type | B | A | B |
| | Ether type | B | B | A |

(Evaluation)
Overall judgment:
A: Properties of the lubricating oil composition was not change.
B: Properties of the lubricating oil composition was a little change, but an operating performance of the watch was acceptable.
C: Properties of the lubricating oil composition was change, and an operating performance of the watch was not acceptable.

Example 21

To lithium soap grease (A2-3), trixylenyl phosphate was added as an anti-wear agent in an amount of 2% by weight to prepare a lithium soap grease composition. Separately, to the lithium soap grease composition, PTFE particles (particle diameter: 0.5 to 8 μm) was added as a solid lubricant in an amount of 3% by weight to prepare lithium soap grease composition containing a solid lubricant.

Using the lithium soap grease compositions containing a solid lubricant, a watch movement (Citizen Watch #2035, train wheel portion: made of metal (mainly made of brass and iron)) was assembled. A crown was pulled to cause the watch to be in a state of adjusting time. The crown was continuously rotated for 2 hours, and a slip torque was measured.

Thereafter, the watch was disassembled and washed, and the watch was re-assembled using as a grease composition the lithium soap grease composition containing no solid lubricant. A crown was pulled to cause the watch to be in a state of adjusting time. The crown was continuously rotated for 2 hours, and a slip torque was measured.

The slip torque decrease ratio of the watch are set forth in Table 20.

Comparative Example 6

A slip torque was measured in the same manner as in Example 21, except that the lithium soap grease composition containing no solid lubricant was used as both of a grease compositions.

TABLE 20

| | Torque decrease |
|---|---|
| Ex. 21 | 6.0% |
| Comp. Ex. 6 | 19.8% |

According to Table 20, in the watch which was first assembled using the grease composition containing a solid lubricant, even when the watch was disassembled, washed and re-assembled using the grease composition containing no solid lubricant, it has been confirmed that a decrease of a slip torque is inhibited.

For the watches assembled using each of the polyol ester type grease composition and the ether type grease composition, the same results were obtained.

By the use of the grease composition for a precision instrument of the invention for a sliding mechanism of a precision instrument such as a watch, a stable slip torque can be obtained, and the precision instrument such as a watch can be stably operated. Further, by the use of the grease composition for a precision instrument of the invention for a sliding mechanism of a precision instrument such as a watch in combination with the same type of a lubricating oil composition as the grease composition, properties of the lubricating oil are not changed, and the precision instrument such as a watch can be stably operated.

What is claimed is:

1. A watch, wherein a grease composition for a precision instrument is used to lubricate a sliding mechanism of its slide portion, wherein the grease composition for a precision instrument comprises a lithium soap grease or a urea grease, and an anti-wear agent;

wherein the lithium soap grease and the urea grease are each a grease having no hydroxyl group in a molecule, the anti-wear agent is contained in an amount of 0.1 to 20% by weight based on the total amount of the grease composition, and the anti-wear agent is at least one compound selected from a neutral phosphate, a neutral phosphite and calcium borate.

2. The watch as claimed in claim 1, wherein the lithium soap grease or the urea grease is obtained from a polyol ester oil having no hydroxyl group in a molecule.

3. The watch as claimed in claim 1, wherein the lithium soap grease or the urea grease is obtained from a paraffinic hydrocarbon oil comprising an α-olefin polymer of 30 or more carbon atoms.

4. The watch as claimed in claim 1, wherein the lithium soap grease or the urea grease is obtained from an ether oil having no hydroxyl group in a molecule.

5. The watch as claimed in claim 4, wherein the ether oil is an ether oil represented by the following formula (1):

$$R_1-(O-R_2)_n-R_3 \quad (1)$$

wherein $R_1$ and $R_3$ are each independently an alkyl group of 1 to 18 carbon atoms or a monovalent aromatic hydrocarbon group of 6 to 18 carbon atoms, $R_2$ is an alkylene group of 1 to 18 carbon atoms or a divalent aromatic hydrocarbon group of 6 to 18 carbon atoms, and n is an integer of 1 to 5.

6. The watch as claimed in claim 1, further comprising a solid lubricant in an amount of 0.01 to 5% by Weight based on the total amount of the grease composition.

7. The watch as claimed in claim 6, wherein the solid lubricant comprises molybdenum disulfide and/or PTFE particles.

8. The watch as claimed in claim 1, further comprising a metal deactivator.

9. The watch as claimed in claim 8, wherein the metal deactivator is benzotriazole and/or a derivative thereof.

10. The watch as claimed in claim 1, further comprising an antioxidant.

11. The watch as claimed in claim 10, wherein the antioxidant is a phenol type antioxidant and/or an amine type antioxidant.

12. The watch as claimed in claim 11, wherein the phenol type antioxidant is 2,6-di-tributyl-p-cresol, 2,4,6-tri-t-butylphenol or 4,4'-methylenebis (2,6-di-tributylphenol).

13. The watch as claimed in claim 11, wherein the amine type antioxidant is a diphenylamine derivative.

14. The watch as claimed in claim 1, wherein the change in weight of the lithium soap grease or the urea grease after the grease is held at 90° C. for 1,000 hours is not more than 10% by weight.

15. The watch as claimed in claim 1, which has a total acid number of not more than 0.2 mg KOH/g.

16. The watch as claimed in claim 2, wherein the grease composition for a precision instrument is used to lubricate the sliding mechanism of its slide portion, a lubricating oil composition is used to lubricate portions other than the sliding mechanism of the slide portion, and the lubricating oil composition is a lubricating oil composition obtained from the polyol ester oil having no hydroxyl group in a molecule.

17. The watch as claimed in claim 3, wherein the grease composition for a precision instrument is used to lubricate the sliding mechanism of its slide portion, a lubricating oil composition is used to lubricate portions other than the sliding mechanism of the slide portion, and the lubricating oil composition is a lubricating oil composition obtained from the paraffinic hydrocarbon oil comprising an α-olefin polymer of 30 or more carbon atoms.

18. The watch as claimed in claim 4, wherein the grease composition for a precision instrument is used to lubricate a sliding mechanism of a slide portion, a lubricating oil composition is used to lubricate portions other than the sliding mechanism of the slide portion, and the lubricating oil composition is a lubricating oil composition obtained from the ether oil having no hydroxyl group in a molecule.

* * * * *